US012330765B1

(12) United States Patent
Xu et al.

(10) Patent No.: US 12,330,765 B1
(45) Date of Patent: Jun. 17, 2025

(54) POWER AND FRESHWATER SUPPLY SYSTEM FOR OCEAN INTEGRATED PLATFORM

(71) Applicants: Jiangsu University of Science and Technology, Jiangsu (CN); MARINE TECHNOLOGY INNOVATION CENTER •YANGTZE DELTA, Jiangsu (CN)

(72) Inventors: Lixin Xu, Jiangsu (CN); Yajiao Liu, Jiangsu (CN); Peilin Dou, Jiangsu (CN); Xiu Li, Jiangsu (CN); Shuguang Zhang, Jiangsu (CN); Zhichao Hong, Jiangsu (CN); Chaoshuai Han, Jiangsu (CN)

(73) Assignees: Jiangsu University of Science and Technology, Zhenjiang (CN); MARINE TECHNOLOGY INNOVATION CENTER · YANGTZE DELTA, Nantong (CN)

( * ) Notice: Subject to any disclaimer, the term of this patent is extended or adjusted under 35 U.S.C. 154(b) by 0 days.

(21) Appl. No.: 19/031,747

(22) Filed: Jan. 18, 2025

(30) Foreign Application Priority Data

May 16, 2024 (CN) ..... 202410606645.3

(51) Int. Cl.
*B63J 1/00* (2006.01)
*B63B 35/44* (2006.01)

(52) U.S. Cl.
CPC ..... *B63J 1/00* (2013.01); *B63B 35/44* (2013.01); *B63B 2035/446* (2013.01)

(58) Field of Classification Search
CPC ..... B60J 1/00; B63B 35/44; B63B 2035/446
See application file for complete search history.

(56) References Cited

FOREIGN PATENT DOCUMENTS

CN 217077041 U * 7/2022 ..... Y02E 10/30
CN 217761215 U * 11/2022 ..... Y02E 10/30

* cited by examiner

*Primary Examiner* — S. Joseph Morano
*Assistant Examiner* — Jovon E Hayes

(57) ABSTRACT

Disclosed is a power and freshwater supply system for an ocean integrated platform, falling within the field of offshore integrated power generation technologies and methods. A wind farm, a compressed air energy storage system with heat storage, a vortex tube, a temperature difference energy power generation system, and an energy management system are included. Leveraging the complementary characteristics of wind energy and temperature difference energy, a sustainable power and freshwater supply system for an ocean integrated platform is established, providing clean and reliable energy and freshwater resources for facilities such as islands in deep and distant sea, offshore oilfields, and mariculture.

1 Claim, 3 Drawing Sheets

POWER AND FRESHWATER SUPPLY SYSTEM FOR OCEAN INTEGRATED PLATFORM

CROSS-REFERENCE TO RELATED APPLICATION

This application claims priority of Chinese Patent Application No. 202410606645.3, filed on May 16, 2024, the entire contents of which are incorporated herein by reference.

TECHNICAL FIELD

The present disclosure belongs to the field of offshore integrated power generation technologies and methods, and relates to a power and freshwater supply system for an ocean integrated platform, and specifically relates to a power and freshwater supply system for an ocean integrated platform based on the principles of wind power generation-temperature difference power generation.

BACKGROUND

With the rapid development of society, people are gradually seeking for available clean energy in the deep and distant sea. Wind power generation and temperature difference energy power generation technologies can realize the development and utilization of clean energy, but they cannot provide stable and continuous power supply. Therefore, how to solve this problem is a matter that needs to be considered and solved.

SUMMARY

In response to the above problem, an objective of the present disclosure is to provide a power and freshwater supply system for an ocean integrated platform.

Technical solutions of the present disclosure are as follows. A power and freshwater supply system for an ocean integrated platform of the present disclosure includes a wind farm, an air compressor, a heat storage system, an air storage chamber, heat storage-heat exchange units, a warm seawater tank, a vortex tube, a freshwater tank, an expansion machine, and an energy management system.

One end of the wind farm is connected to an engine. The wind farm is connected to one end of the air compressor via the engine, and the other end of the air compressor is connected to one end of the heat storage system. A second end of the heat storage system is connected to one end of the air storage chamber, and the other end of the air storage chamber is connected to one end of the vortex tube, and the other end of the vortex tube is connected to one end of the freshwater tank.

A third end of the heat storage system is connected to one end of the heat storage-heat exchange unit, and the other end of the heat storage-heat exchange unit is connected to one end of the expansion machine, and the other end of the expansion machine is connected to a second end of the freshwater tank.

A third end of the expansion machine is connected to a generator, and the third end of the expansion machine is connected to one end of the energy management system via the arranged generator, and the other end of the energy management system is connected to a second end of the wind farm.

Further, a fourth end of the heat storage system is connected to one end of the warm seawater tank, and the other end of the warm seawater tank is connected to one end of the expansion machine.

Further, a third end of the vortex tube is connected to a third end of the warm seawater tank, and a fourth end of the warm seawater tank is connected to the freshwater tank.

Further, third ends of the heat storage-heat exchange units are commonly connected to a working fluid pump, and the other end of the working fluid pump is connected to a connection end between the heat storage system and the warm seawater tank.

Further, a condensation tube is arranged inside the freshwater tank.

Further, the vortex tube includes a cold end tube and a hot end tube connected to each other, and a central nozzle is disposed at one end of the vortex tube near the air storage chamber, and a vortex chamber is disposed at a corresponding position of the central nozzle near one end of the freshwater tank.

A hot end regulation valve is arranged at one end of the vortex tube near the warm seawater tank.

Further, the warm seawater tank includes an upper layer structure and a lower layer structure, with the lower layer structure storing surface seawater pumped by a seawater pump, and the upper layer structure holding a heating and evaporation device.

Further, a raw material inlet is disposed at an upper end of the warm seawater tank, and a heating steam inlet connected to the heat storage system and the working fluid pump is disposed at a lower end.

A heating tube is arranged inside the warm seawater tank, a lower end of the heating tube is connected to a circulation tube via an arranged pipeline, and an evaporation chamber is arranged at an upper end of the circulation tube. An upper end of the heating tube is connected to the evaporation chamber via an arranged pipeline, and a secondary steam outlet connected to the expansion machine is disposed at an upper end of the evaporation chamber.

Further, a condensate water outlet connected to the condensation tube is disposed at a bottom end of the heating tube.

Further, the energy management system includes a human-machine interaction module, a data analysis module, and a prediction and decision-making module connected each other.

The basic principles of the present disclosure are as follows.

1. A wind generator, a compressed air energy storage system with heat storage, and temperature difference energy power generation are combined to conserve energy and improve power generation efficiency.

2. In the present disclosure, by arranging the vortex tube, cold and hot air are separated from the high-pressure air through vortex, and are utilized in a temperature difference energy power generation system to achieve full energy utilization.

3. The energy management system serves for monitoring and controlling the distribution of energy, and conducting real-time monitoring and intelligent control over all links of energy production and distribution, achieving effective scheduling strategies.

The present disclosure has the following beneficial effects. 1. Leveraging the compressed air energy storage mode with heat storage can achieve peak-load shifting and primary frequency regulation, thereby enhancing grid stability, and improving the quality of electrical energy. The stored heat can not only be directly used to generate power through the expansion machine but also be used to evaporate and heat warm seawater, and serves as a crucial part of the temperature difference energy power generation system to improve resource utilization efficiency, without waste gas generation, achieving high efficiency and cleanliness. 2. The vortex tube is used to separate cold and hot air through vortex, and the cold and hot air can be utilized separately in the temperature difference energy system. The cold air can act on the condensation tube to generate freshwater, which is an indispensable resource for human life and production, and is relatively limited. This method can produce freshwater and can directly serve for ultra-deep-sea platforms such as deep-sea aquaculture and offshore oilfields. 3. Renewable energy power generation technologies are unstable, and the energy management system is utilized to monitor and control the power generation system, so that fine management of renewable energy facilities can be achieved, improving energy utilization efficiency, reducing operating costs, and positively contributing to grid stability and the sustainable development of renewable energy.

Figure 1:
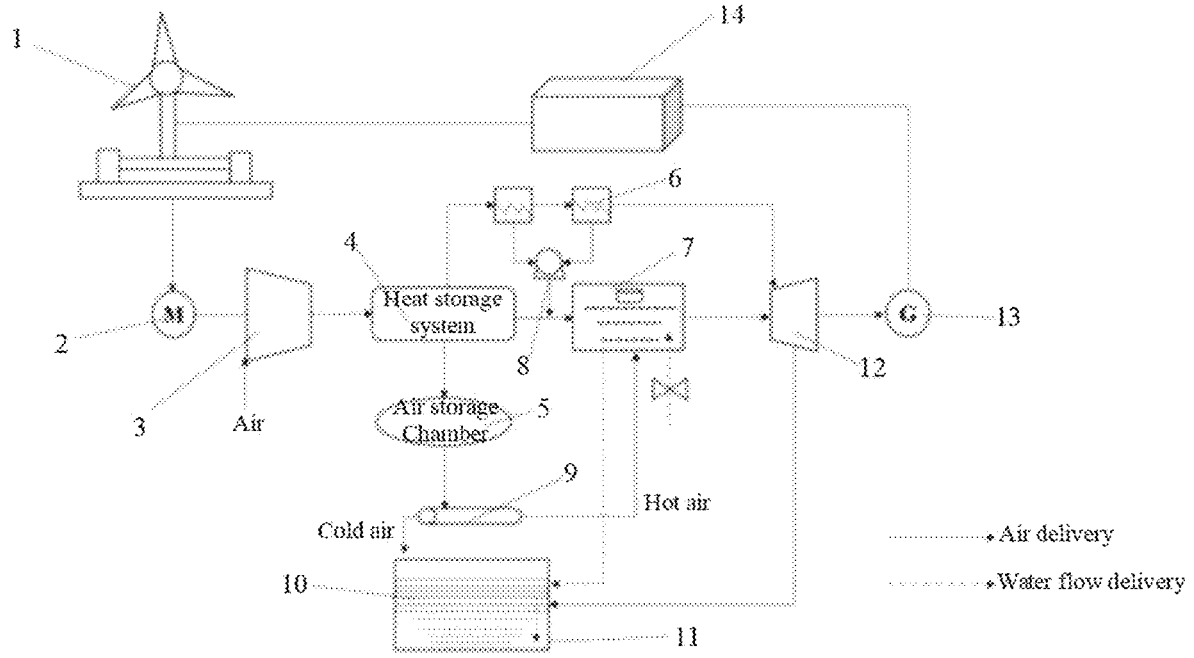
FIG. 1 is an overall schematic structural diagram of the present disclosure.
Figure 2:
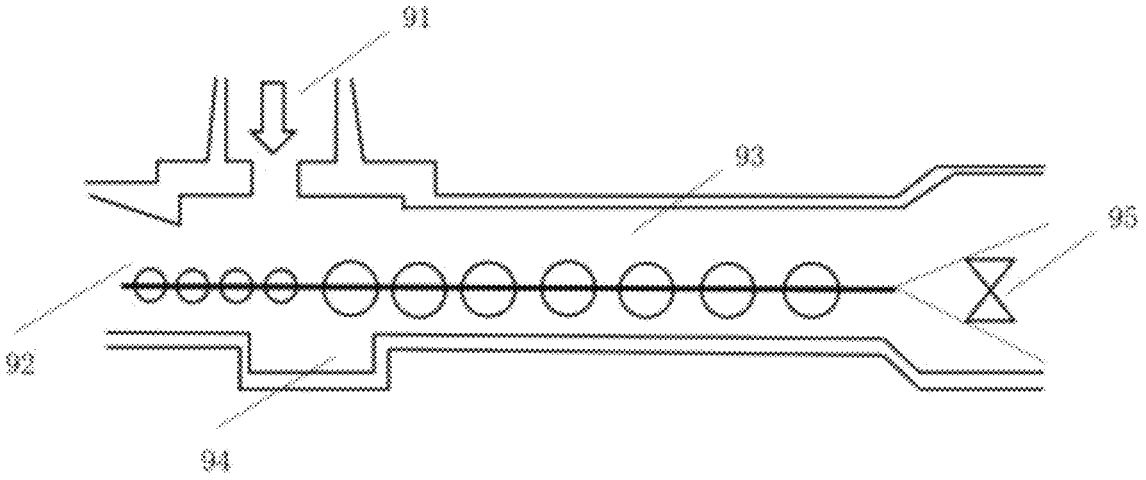
FIG. 2 is an internal schematic structural diagram of a vortex tube of the present disclosure.
Figure 3:
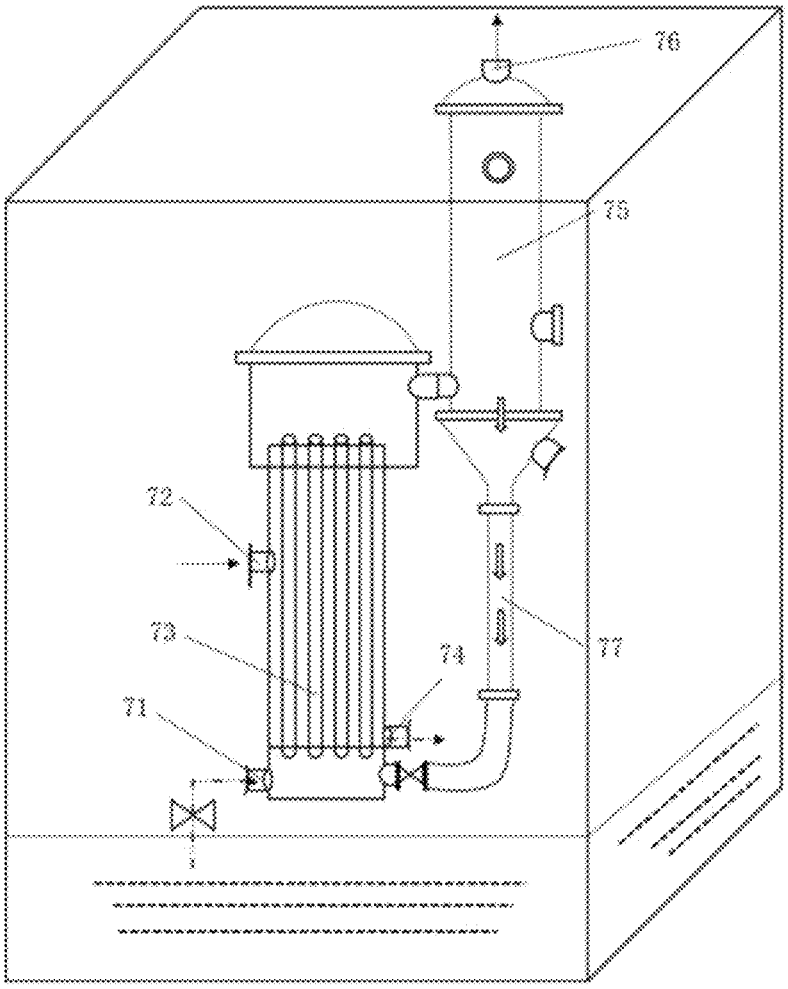
FIG. 3 is an internal schematic structural diagram of a warm seawater tank of the present disclosure.
Figure 4:
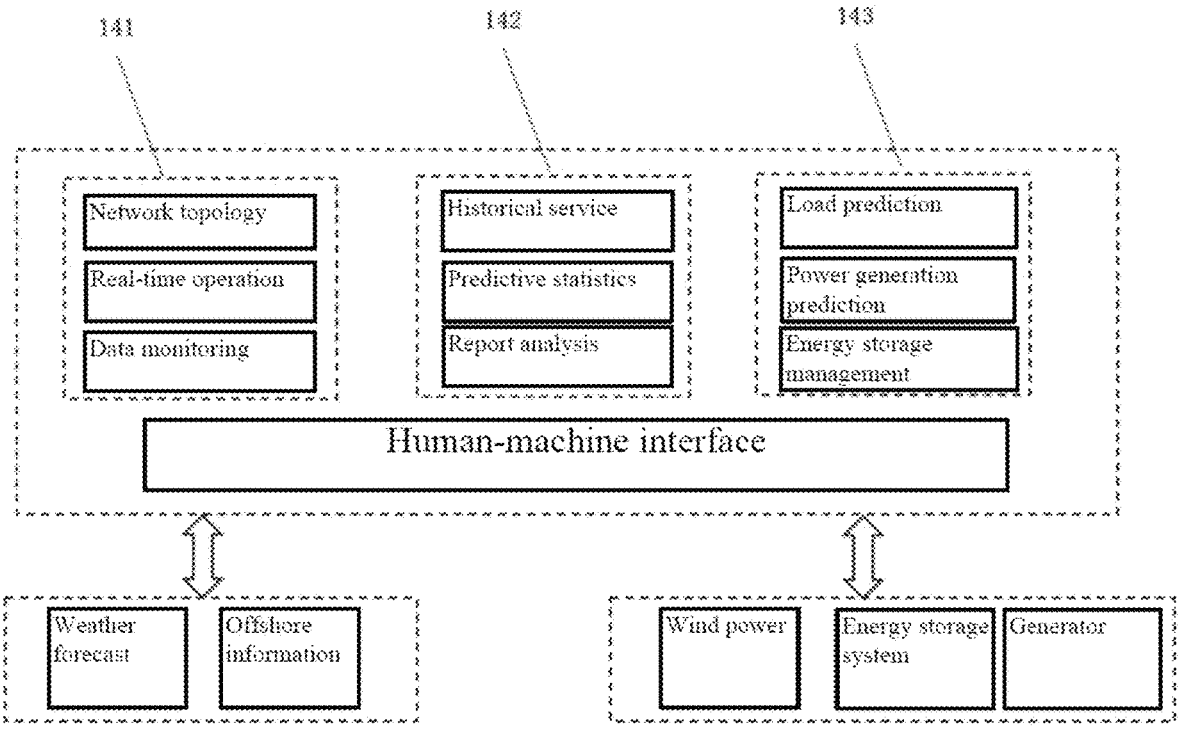
FIG. 4 is a module schematic diagram of an energy management system of the present disclosure.

Reference numerals and denotations thereof: 1—wind farm, 2—engine, 3—air compressor, 4—heat storage system, 5—air storage chamber, and 6—heat storage-heat exchange unit;

- 7—warm seawater tank, 71—raw material inlet, 72—heating steam inlet, 73—heating tube, 74—condensate water outlet, 75—evaporation chamber, 76—secondary steam outlet, and 77—circulation pipe; 8—working fluid pump;
- 9—vortex tube, 91—central nozzle, 92—cold end tube, 93—hot end tube, 94—vortex chamber, and 95—hot end regulation valve;
- 10—condensation tube, 11—freshwater tank, 12—expansion machine, and 13—generator; and
- 14—energy management system, 141—human-machine interaction module, 142—data analysis module, and 143—prediction and decision-making module.

DETAILED DESCRIPTION

The specific technical solutions of the present disclosure are described in combination with the specific examples in detail below.

As shown in figures, the present disclosure provides a power and freshwater supply system for an ocean integrated platform (a power and freshwater supply system for an ocean integrated platform based on the principles of wind power generation-temperature difference power generation). This system employs a combination of a wind farm 1 and temperature difference energy technology for power generation, and takes a compressed air energy storage system with heat storage as an energy storage device. When wind energy is abundant, renewable energy is directly utilized to output electric energy for power generation. Additionally, excess wind energy can be compressed into the energy storage system, where it passes through heat storage-heat exchange units 6 to evaporate warm seawater, and then is transported to an expansion machine 12 to generate power. Furthermore, the air is separated through a vortex tube 9, and the cold air acts on a condensation tube 10, and freshwater may be generated. The energy management system 14 serves for monitoring and controlling the distribution of energy, and conducting real-time monitoring and intelligent control over all links of energy production and distribution, achieving effective scheduling strategies.

Further, the compressed air energy storage system with heat storage mainly includes equipment such as an air compressor 3, a heat storage system 4, an air storage chamber 5, heat storage-heat exchange units 6, and an expansion machine 12. When the electric energy generated by the wind farm 1 is higher than actual demand, the engine 2 drives the air compressor 3 to compress air into high-temperature and high-pressure air. The heat is stored in the heat storage system 4, and the air is stored in the air storage chamber 5. The heat storage system 4 releases energy to the heat storage-heat exchange unit 6, and the energy then enters the expansion machine 12 to generate power. Simultaneously, the energy can also be transported to the warm seawater tank 7 to heat and evaporate warm seawater, providing power for the temperature difference energy system for power generation. The liquid acted upon by the heat storage-heat exchange unit 6 can also flow into the warm seawater tank 7 for storage through the arranged working fluid pump 8.

Further, the temperature difference energy power generation system mainly includes equipment such as a heat storage system 4, a warm seawater tank 7, a vortex tube 9, a condensation tube 10, a freshwater tank 11, and an expansion machine 12. The heat from the heat storage system 4 heats and evaporates the seawater within the warm seawater tank 7, and then enters the expansion machine 12 to generate power. The exhausted gas is transported into the condensation tube 10. Simultaneously, the high-pressure air from the air storage chamber 5 enters the vortex tube 9, where cold and hot air streams are separated through vortex. The cold air stream flows over the exterior of the condensation tube 10, creating a temperature difference between the tube wall and the steam inside the condensation tube 10. The heat of the steam inside the tube dissipates, and the steam is cooled and condensed into freshwater, which then flows into the freshwater tank 11 for storage.

Further, an internal structure of the vortex tube 9 includes a central nozzle 91, a cold end tube 92, a hot end tube 93, a vortex chamber 94, and a hot end regulation valve 95. When the high-pressure air from the air storage chamber 5 is delivered to the central nozzle 91, it expands and is injected tangentially into the vortex chamber 94, forming a free vortex. Due to differences in angular velocity and the presence of friction, the air begins to stratify, with cold air stream flowing towards the cold end tube 92 and hot air stream flowing towards the hot end tube 93. The flow rate of the air can be adjusted through the hot end regulation valve 95 to achieve the desired temperature. The hot end tube 93 of the vortex tube 9 is connected to the warm seawater tank 7, so that the seawater can be heated and evaporated, providing power for temperature difference energy power generation. The cold air stream of the cold end tube 92 of the vortex tube 9 flows over the exterior of the condensation tube 10, and the steam inside the condensation tube 10 is cooled and condensed into freshwater for storage.

Further, the warm seawater tank 7 includes an upper layer structure and a lower layer structure, with the lower layer structure storing surface seawater pumped by a seawater pump, and the upper layer structure holding a heating and evaporation device.

The warm seawater is pumped into the raw material inlet 71. The heating steam inlet 72 is connected to the heat storage system 4 and the working fluid pump 8. Steam from the heat storage system 4 and the working fluid pump 8, along with circulating steam, can enter the heating tube 73 through the heating steam inlet 72 to heat the warm seawater. As the temperature rises, gas-liquid separation occurs, and the condensate water flows through the condensate water outlet 74 to the exterior of the condensation tube 10, where freshwater can be further generated through condensation for collection. The evaporated gas enters the evaporation chamber 75 for secondary evaporation, and the secondary evaporated gas is ejected through the secondary steam outlet 76. Since the secondary steam outlet 76 is connected to the expansion machine 12, the gas can enter the expansion machine 12, where it expands and works. The remaining liquid continues to enter the circulation tube 77 for further circulation.

Further, the energy management system 14 includes a human-machine interaction module 141, a data analysis module 142, and a prediction and decision-making module 143. External information such as weather forecasts is transmitted to the energy management system through data interfaces. Additionally, electricity from the wind farm 1 and the generator 13 is delivered to the energy storage system within the energy management system 14, so that power fluctuations from renewable energy sources and loads can be inhibited stably, maintaining real-time power balance in the system. Simultaneously, instructions from the energy management system 14 are received to determine power generation modes and power levels, ensuring stable power output, and allowing for peak-load shifting and optimal energy dispatch.

The present disclosure contains a wind farm, a compressed air energy storage system with heat storage, a temperature difference energy power generation system, a vortex tube 9, and an energy management system 14. The compressed air energy storage system with heat storage stores excess electrical energy by compressing air and releases high-pressure air through the expansion machine 12 to generate power when needed, which can improve the grid load rate and reduce load fluctuations in large generator sets within the system. The vortex tube 9 is capable of creating a vortex in high-speed air stream to separate it into cold and hot air streams. The cold air stream is utilized in the temperature difference energy power generation system, reducing energy loss and improving energy utilization efficiency. The energy management system 14 is used for monitoring and controlling energy distribution, and providing real-time monitoring and intelligent control of all links of energy production and distribution, achieving effective scheduling strategies. Leveraging the complementary characteristics of wind energy and temperature difference energy, combined with advanced energy storage technology, this system obtains stable power resources. A sustainable power and freshwater supply system for an ocean integrated platform is established, providing clean and reliable energy and freshwater resources for facilities such as islands in deep and distant sea, offshore oil fields, and mariculture.

The invention claimed is:

1. A power and freshwater supply system for an ocean integrated platform, comprising a wind farm (1), an air compressor (3), a heat storage system (4), an air storage chamber (5), heat storage-heat exchange units (6), a warm seawater tank (7), a vortex tube (9), a freshwater tank (11), an expansion machine (12), and an energy management system (14), wherein one end of the wind farm (1) is connected to an engine (2), the wind farm (1) is connected to one end of the air compressor (3) via the engine (2), the other end of the air compressor (3) is connected to one end of the heat storage system (4), a second end of the heat storage system (4) is connected to one end of the air storage chamber (5), the other end of the air storage chamber (5) is connected to one end of the vortex tube (9), and the other end of the vortex tube (9) is connected to one end of the freshwater tank (11);

a third end of the heat storage system (4) is connected to one end of the heat storage-heat exchange unit (6), the other end of the heat storage-heat exchange unit (6) is connected to one end of the expansion machine (12), and the other end of the expansion machine (12) is connected to a second end of the freshwater tank (11);

a third end of the expansion machine (12) is connected to a generator (13), the third end of the expansion machine (12) is connected to one end of the energy management system (14) via the arranged generator (13), and the other end of the energy management system (14) is connected to a second end of the wind farm (1);

a fourth end of the heat storage system (4) is connected to one end of the warm seawater tank (7), and the other end of the warm seawater tank (7) is connected to one end of the expansion machine (12);

a third end of the vortex tube (9) is connected to a third end of the warm seawater tank (7), and a fourth end of the warm seawater tank (7) is connected to the freshwater tank (11);

third ends of the heat storage-heat exchange units (6) are commonly connected to a working fluid pump (8), and the other end of the working fluid pump (8) is connected to a connection end between the heat storage system (4) and the warm seawater tank (7);

a condensation tube (10) is arranged inside the freshwater tank (11);

the vortex tube (9) comprises a cold end tube (92) and a hot end tube (93) connected to each other, a central nozzle (91) is disposed at one end of the vortex tube (9) near the air storage chamber (5), and a vortex chamber (94) is disposed at a corresponding position of the central nozzle (91) near one end of the freshwater tank (11);

a hot end regulation valve (95) is arranged at one end of the vortex tube (9) near the warm seawater tank (7);

the warm seawater tank (7) comprises an upper layer structure and a lower layer structure, with the lower layer structure storing surface seawater pumped by a seawater pump, and the upper layer structure holding a heating and evaporation device;

a raw material inlet (71) is disposed at an upper end of the warm seawater tank (7), and a heating steam inlet (72) connected to the heat storage system (4) and the working fluid pump (8) is disposed at a lower end;

a heating tube (73) is arranged inside the warm seawater tank (7), a lower end of the heating tube (73) is connected to a circulation tube (77) via an arranged pipeline, an evaporation chamber (75) is arranged at an upper end of the circulation tube (77), an upper end of the heating tube (73) is connected to the evaporation chamber (75) via an arranged pipeline, and a secondary steam outlet (76) connected to the expansion machine (12) is disposed at an upper end of the evaporation chamber (75);

a condensate water outlet (74) connected to the condensation tube (10) is disposed at a bottom end of the heating tube (73); and the energy management system (14) comprises a human-machine interaction module (141), a data analysis module (142), and a prediction and decision-making module (143) connected each other.

* * * * *